US006378918B1

(12) United States Patent
Mita et al.

(10) Patent No.: US 6,378,918 B1
(45) Date of Patent: Apr. 30, 2002

(54) COVER MEMBER SECURING STRUCTURE

(75) Inventors: Chikara Mita; Hiromi Etsumi, both of Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 34 days.

(21) Appl. No.: 09/606,672

(22) Filed: Jun. 30, 2000

(30) Foreign Application Priority Data

Jul. 2, 1999 (JP) ..... 11-188945

(51) Int. Cl.[7] ..... E05C 19/10

(52) U.S. Cl. ..... 292/103; 292/113; 292/DIG. 16; 292/87

(58) Field of Search ..... 292/66, 70, 87, 292/89, 80, 103, 114, 113, 128, 228, 204, 202, 322, 209, 303, 253, 340, DIG. 11, DIG. 49, DIG. 30, DIG. 16, DIG. 38; 220/323, 810, 824, 324, 811

(56) References Cited

U.S. PATENT DOCUMENTS

| | | | | | |
|---|---|---|---|---|---|
| 2,358,607 | A | * | 9/1944 | Tinnerman | 292/87 |
| 2,402,939 | A | * | 7/1946 | Auslander et al. | 292/14 |
| 2,786,596 | A | * | 9/1957 | Claude-Mantle | 220/469 |
| 4,270,668 | A | * | 6/1981 | Berfield | 220/324 |
| 5,037,146 | A | * | 8/1991 | Kolb et al. | 292/202 |
| 5,738,390 | A | * | 4/1998 | Yemini | 292/87 |
| 6,129,395 | A | * | 10/2000 | Schlesener et al. | 292/128 |

* cited by examiner

*Primary Examiner*—Christopher P. Schwartz
*Assistant Examiner*—Benjamin A. Pezzlo
(74) *Attorney, Agent, or Firm*—Sughrue Mion, PLLC

(57) ABSTRACT

A pair of hold pieces 19, which elastically hold the two side edges 25 of an elastic securing member 21 for mounting a cover member 12 onto a housing 11 to thereby be able to position the shifting inclination position of the elastic securing member 21 provisionally at an arbitrary position, are disposed in either of the housing 11 or cover member 12 which supports the elastic securing member 21.

5 Claims, 5 Drawing Sheets

COVER MEMBER SECURING STRUCTURE

BACKGROUND OF THE INVENTION

1. Field of the Invention

The present invention relates to a structure for securing a cover member to a housing such as an electrical connection box or a fuse box disposed in a vehicle and, in particular, to such cover member securing structure in which an elastic securing member capable of mounting and holding the housing and cover member can be provisionally held at an arbitrary position and the cover member can be thereby secured to the housing smoothly without being interfered by the elastic securing member.

2. Description of the Related Art

For example, in the case of an electrical connection box which is arranged and used within an engine room of a car, in order to prevent water from invading into the electrical connection box, there is required a cover securing structure which can secure the electrical connection box and cover member to each other in such a manner that a sealed or watertight condition can be maintained between them.

As a conventional cover member securing structure of this type for use in an electrical connection box, for example, there is known a cover member securing structure which is disclosed in JP-A-7-39225U. In the present conventional cover member securing structure, as shown in FIG. 8, one end portion 3A of an elastic securing member 3, which is formed of metal in a band shape, is oscillatably supported on the side surface of a housing 1 and, at the same time, the other end portion of the elastic securing member 3 is formed as a securing portion 3B which can be secured to a cover member 2. Also, on the side surface of the cover member 2 to be mounted on the housing 1, there is formed an engaging stepped portion 2A with which the securing portion 3B of the elastic securing member 3 can be engaged. In actual assembly, after the cover member 2 is mounted onto the housing 1, the securing portion 3B of the elastic securing member 3, which is oscillatably supported on the side surface of the housing 1, is engaged with the engaging stepped portion 2A of the cover member 2, so that the housing 1 and cover member 2 can be secured together in a mutually sealed condition.

Also, according to the conventional cover member securing structure, in the elastic securing member 3, there is disposed an elastic tongue piece 3C cut and raised so as to project toward the side surface of the housing 1; that is, the leading end of the elastic tongue piece 3C is brought into contact with a projecting surface 1A provided on the side surface of the housing 1, thereby elastically restricting the movement of the elastic securing member 3 in the closing direction thereof. Therefore, due to the mutual contact action between the elastic tongue piece 3C of the elastic securing member 3 and the projecting surface 1A of the housing 1, the elastic securing member 3 supported on the housing 1, as shown in FIG. 8, is prevented from inclining in the closing direction. Thanks to this, when mounting the cover member 2 onto the housing 1, the elastic securing member 3 is prevented from being sandwiched between the housing 1 and cover member 2, so that the mounting operation of the cover member 2 onto the housing 1 can be executed smoothly.

Also, after the cover member 2 is mounted onto the housing 1, the elastic securing member 3, as shown by a solid line in FIG. 9, is inclined in the closing direction against the elastic force of the elastic tongue piece 3C thereof to thereby bring the securing portion 3B of the elastic securing member 3 into engagement with the engaging stepped portion 2A of the cover member 2, so that the housing 1 and cover member 2 can be secured together in a mutually sealed condition.

However, in the above-mentioned elastic securing member 3, although the oscillation of the elastic securing member 3 in the closing direction is restricted due to the action of the elastic tongue piece 3C, there is no means for restricting the oscillation of the elastic securing member 3 in the opening direction thereof. Therefore, for example, as shown in FIG. 10, there is a possibility that the elastic securing member 3 can move due to its own weight more than necessary in the opening direction. Thus, when a large number of housings 1 are delivered or packed while they are piled up vertically, the elastic securing members 3 are greatly projected laterally from the side surfaces of the large number of vertically piled-up housings 1, which results in the worsened efficiency of the delivering or packing operation.

SUMMARY OF THE INVENTION

The present invention aims at eliminating the drawbacks found in the above-mentioned conventional cover member securing structure. Accordingly, it is an object of the invention to provide a cover member securing structure in which an elastic securing member shiftably supported on the side surface of a housing can be provisionally positioned at an arbitrary inclination position, so that not only when mounting the cover member onto the housing, the elastic securing member can be prevented from being sandwiched between the housing to thereby be able to enhance the efficiency of the operation to mount the cover member onto the housing, but also when delivering a large number of housings in such a manner that they are piled up vertically, the quantities of projection (lengths) of the respective elastic securing members, which project from the side surfaces of the housings, can be restricted to thereby being able to facilitate the delivering operation of the housings.

In attaining the above object, according to the invention, there is provided a cover member securing structure, comprising: a housing; a cover member to be mounted on the housing; and, an elastic securing member formed of a band-shaped plate spring so as to have a substantially C-shaped side surface, one end of elastic securing member being shiftably supported on one of the housing and cover member, the other end of the elastic securing member being removably secured to the other of the housing and cover member, wherein a pair of hold pieces for elastically holding between them the two side edges of the elastic securing member to thereby be able to position the shifting inclination position of the elastic securing member provisionally at an arbitrary position are disposed in one of the housing and cover member supporting the elastic securing member.

DETAILED DESCRIPTION OF THE PRESENT INVENTION

Figure 1:
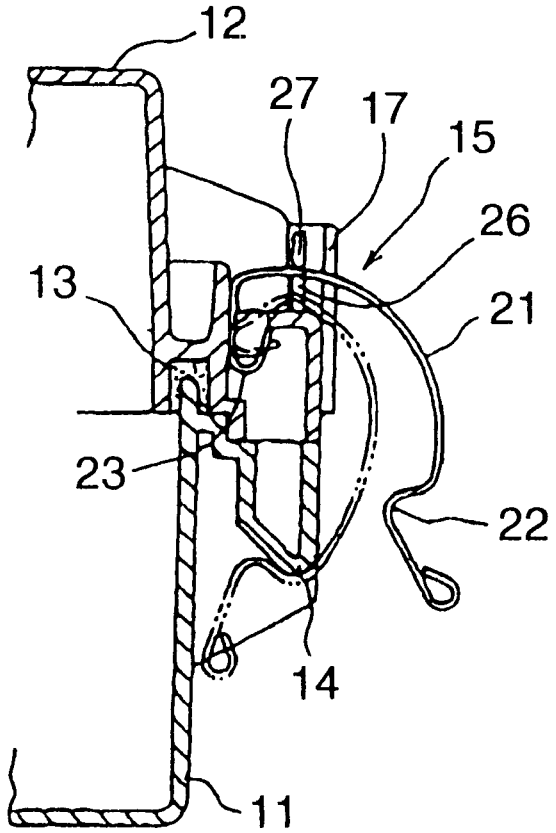
FIG. 1 is a section view of an embodiment of a cover member securing structure according to the invention.
Figure 2:
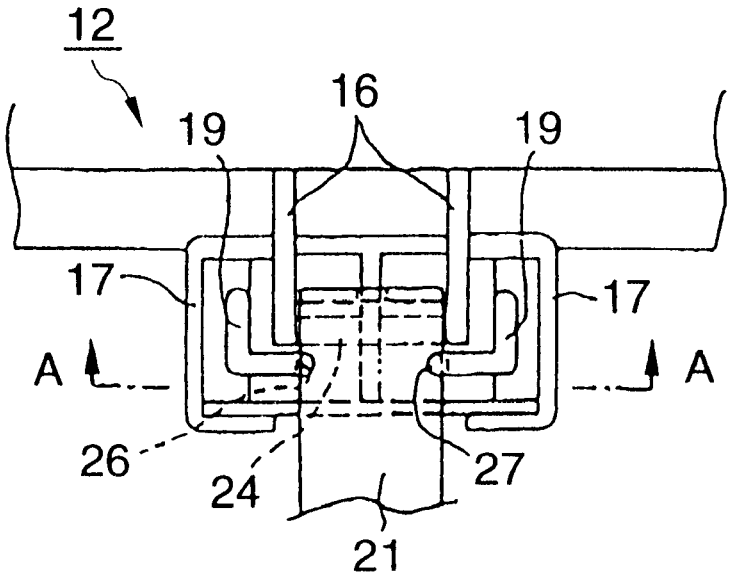
FIG. 2 is a plan view of the embodiment of a cover member securing structure according to the invention.
Figure 3:
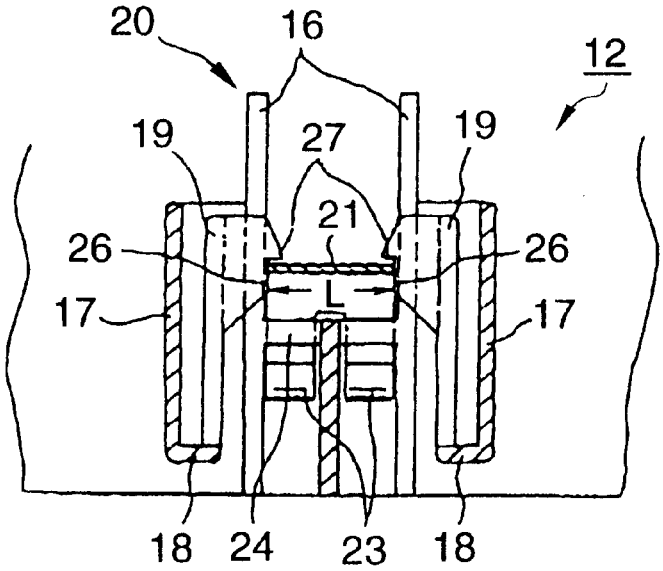
FIG. 3 is a section view taken along the line A—A shown in FIG. 2.

Now, description will be given below in detail of an embodiment of a cover member securing structure according to the invention with reference to FIGS. 1 to 7.

In FIGS. 1 to 4, reference character 11 designates a housing such as a fuse box which is mounted into a car. The housing 11 includes an opening formed in the upper surface thereof. And, there is disposed a cover member 12 which can be mounted onto the opening of the housing 11 with a waterproof packing 13 between them in a watertight manner. At a proper position of the outer surface of the housing 11, there is provided a securing projection 14 which projects toward the direction of the bottom surface of the housing 11. And, at a position of the outer surface of the cover member 12 which corresponds to the securing projection 14, there is disposed a securing structure 15 which cooperates together with the securing projection 14 in mounting the cover member 12 onto the housing 11.

Referring specifically to the securing structure 15, it is composed of an elastic securing member support frame 20 and a band-shaped metal-made elastic securing member 21. More specifically, the elastic securing member support frame 20 comprises: a pair of right and left rib portions 16 which respectively project from the outer surface of the cover member 12 outwardly thereof; a pair of fenders 17 which are integrally fixed to the outer surface of the cover member 12 with their associated rib portions 16 as the fixing support portions thereof, and are positioned so as to face each other, while the pair of fenders provide a substantially U-shaped plan shape; and a pair of right and left elastic hold pieces 19 which are raised upwardly through a pair of right and left flexible connecting portions 18 turned back inwardly of their associated fenders 17 from the lower edges of the fenders 17. And, the band-shaped metal-made elastic securing member 21 is shiftably supported by the elastic securing member support frame 20. Also, the plane surfaces of the hold pieces 19 are respectively formed in a substantially L shape so as to be able to enhance the rigidity of the hold pieces 19.

The side surface of the elastic securing member 21 is formed so as to have a substantially C shape and, in one end portion of the elastic securing member 21, there is formed a securing recessed portion 22 which can be secured to the securing projection 14 provided on the housing 11. And, the other end portion of the elastic securing member 21 is bent formed as a securing portion 23 which can be shiftably and unremovably secured to and held by a beam portion 24 formed so as to bridge over the two rib portions 16 of the elastic securing member support frame 20.

Also, the pair of right and left elastic hold pieces 19 are under the influence of the flexible elasticity of the flexible connecting portions 18 and are thereby elastically energized in the directions where the elastic hold pieces 19 approach each other. And, the mutual distance dimension (L) between two contact edges 26 which are formed in the mutually opposed side edges of the two elastic hold pieces 19 is set smaller than the width dimension of the elastic securing member 21, so that the contact edges 26 of the two elastic hold pieces 19 can be elastically contacted with the two side edges 25 of the elastic securing member 21.

Further, on the upper end portions of the two contact edges 26, there are formed stopper pawls 27 which are used to restrict the shifting area of the elastic securing member 21.

That is, the securing structure 15 formed on the outer surface of the housing 11 is composed of the elastic securing member support frame 20 which, when the cover member 12 is molded of resin, is resin molded integral with the cover member 12, and the band-shaped elastic securing member 21 is made by working a metal-made plate member as a blank member thereof; and, the securing portion 23 formed in the other end portion of the elastic securing member 21 is secured to and held by the elastic securing member support frame 20 in such a manner that it can be oscillated (swung) in a given oscillation range within the elastic securing member 21 but cannot be removed from the interior portion of the elastic securing member 21. Also, the two right and left side edges 25 of the elastic securing member 21 are elastically contacted with the contact edges 26 formed in the two right and left elastic hold pieces 19 to thereby be able to prevent the elastic securing member 21 from being oscillated freely.

After the cover member 12 equipped with the securing structure 15 is mounted on the housing 11, the securing recessed portion 22 of the elastic securing member 21 supported on the cover member 12 is secured to the securing projection 14 formed in the housing 11, thereby maintaining the sealed condition of the cover member 12 on the housing 11. In the present embodiment, the elastic securing member 21 can be provisionally positioned at an arbitrary position due to the hold friction forces of the elastic hold pieces 19.

That is, since the width-direction two side edges 25 of the elastic securing member 21 of the securing structure 15 disposed on the cover member 12 are elastically contacted with the contact edges 26 of the elastic hold pieces 19 formed integral with the cover member 12, the elastic securing member 21 is prevented from being oscillated freely and thus can be provisionally positioned at an arbitrary position within the shifting (swinging) range of the elastic securing member 21.

Figure 4:
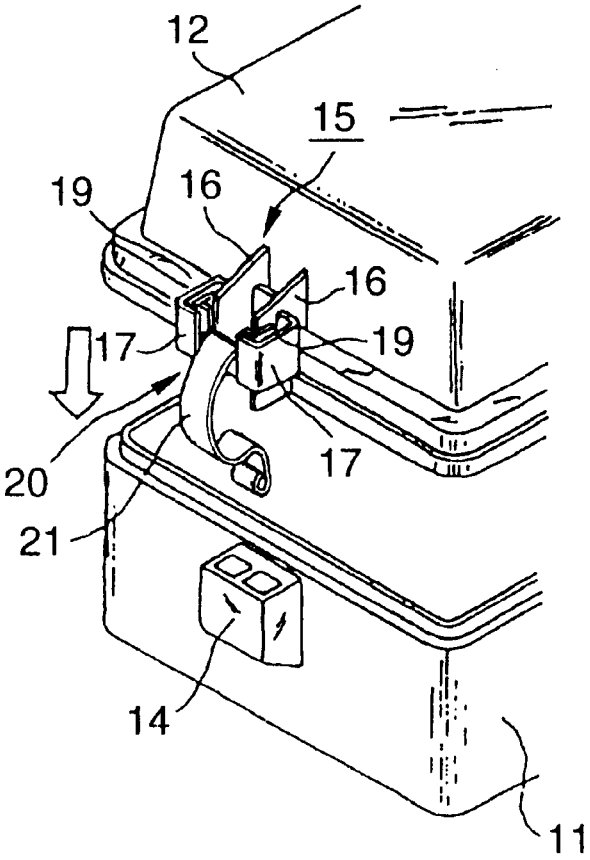
FIG. 4 is an explanatory view of the embodiment of a cover member securing structure according to the invention, showing a state thereof just before a housing and a cover member are mounted on each other.
Figure 5:
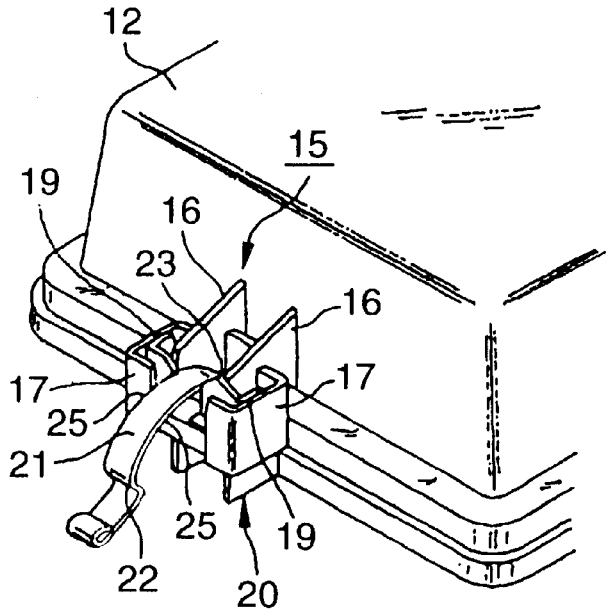
FIG. 5 is a perspective view of the embodiment of a cover member securing structure according to the invention, showing a state thereof in which an elastic securing member is shifted.

Therefore, when placing the cover member 12 equipped with the securing structure 15 onto the housing 11, in order to prevent the elastic securing member 21 of the securing structure 15 from being caught between the cover member 12 and housing 11, the elastic securing member 21 can be provisionally positioned in the opening direction thereof, which makes it possible to carry out the mounting operation of the cover member 12 onto the housing 11 smoothly. After the placing operation of the cover member 12 onto the housing 11 is ended, as shown in FIG. 4, the elastic securing member 21 may be shifted against the provisionally positioning holding forces of the elastic hold pieces in such a manner that the securing recessed portion 22 of the elastic securing member 21 can be engaged with the securing projection 14 of the housing 22. This can complete the mounting of the cover 12 onto the housing 11.

Figure 6:
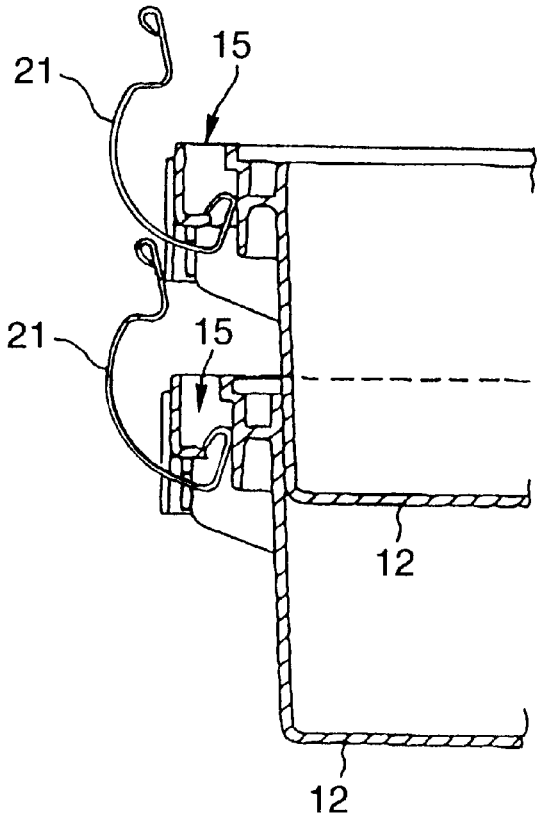
FIG. 6 is a side view of the embodiment of a cover member securing structure according to the invention, showing a state thereof in which the elastic securing member is shifted.

Also, when delivering a large number of cover members 12 each equipped with the securing structure 15 in such a manner that they are piled up vertically, in order to avoid a possibility that the elastic securing members 21 fall down excessively in the lateral direction (opening direction) thereof to thereby provide obstacles to the execution of the delivering operation, for example, as shown in FIG. 6, the elastic securing members 21 may be provisionally positioned in such a manner that they can take up their respective almost uprising positions, so that the elastic securing members 21 can be prevented from interfering with the piling-up and delivering operations. This can facilitate the piling-up operation of a large number of cover members 12 as well as the delivering or packing operation of a large number of cover members 12 after they are piled up vertically.

Figure 7:
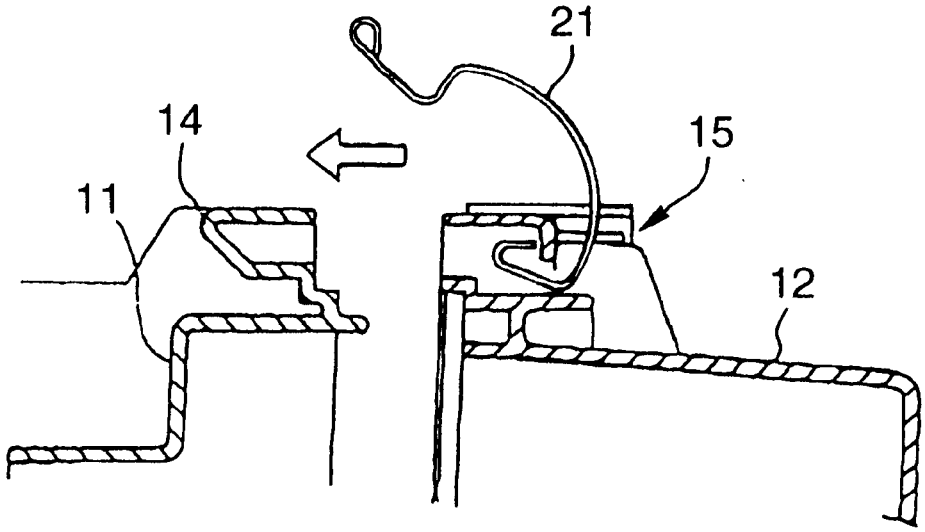
FIG. 7 is a side view of the embodiment of a cover member securing structure according to the invention, showing a state thereof in which the elastic securing member is shifted.
Figure 8:
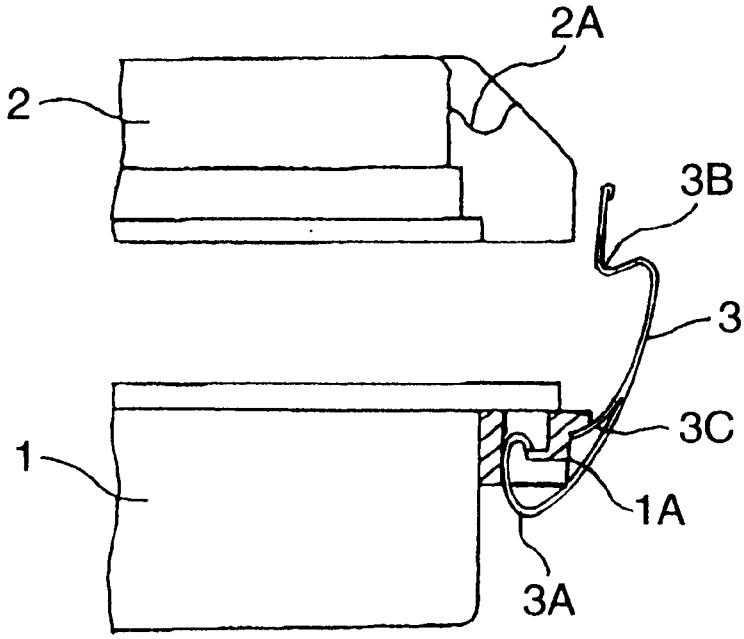
FIG. 8 is a side view of a conventional buckle type securing member.
Figure 9:
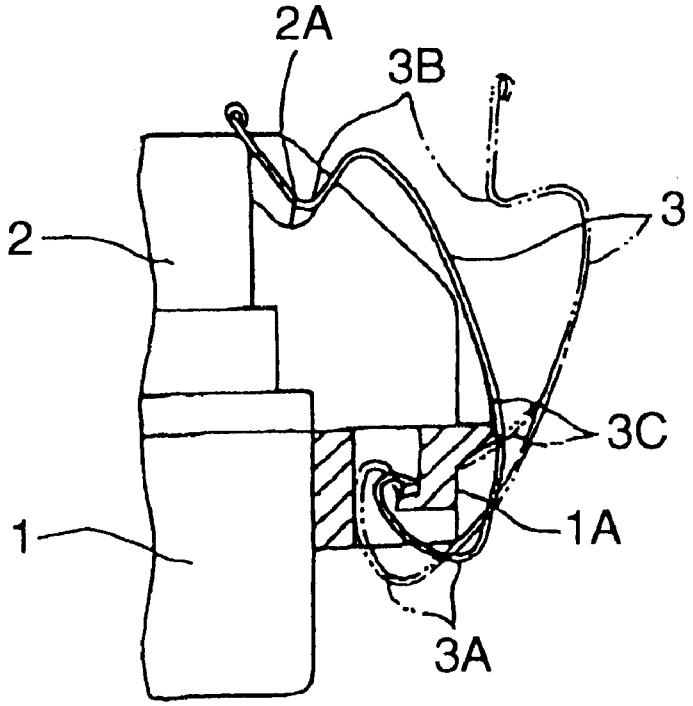
FIG. 9 is an explanatory view of the operation of the conventional buckle type securing member.
Figure 10:
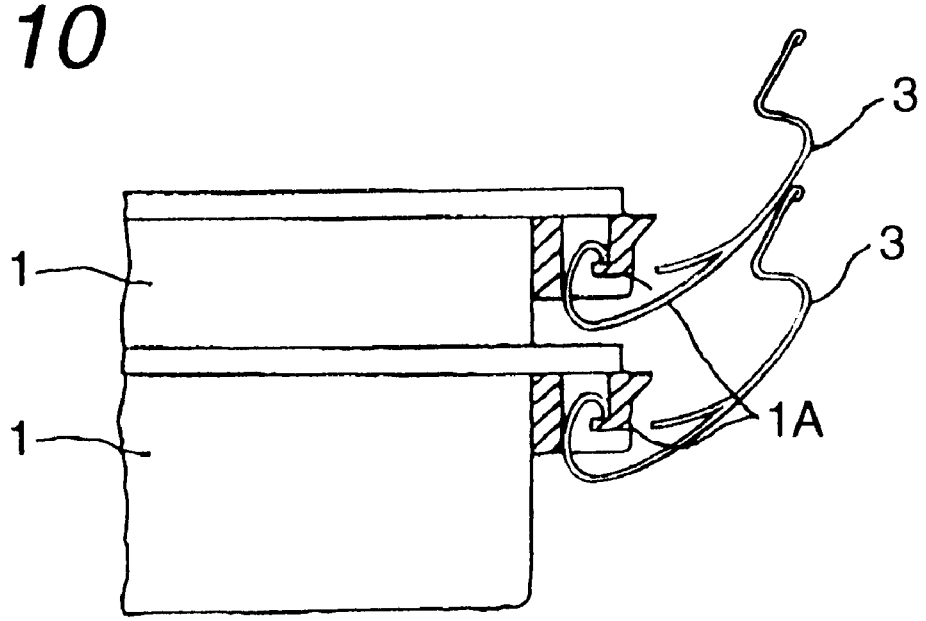
FIG. 10 is a side view of a conventional elastic securing member, showing a state thereof in which it is shifted.

Also, as shown in FIG. 7, when mounting the cover member 12 equipped with the securing structure 15 onto the housing 11 in a state where the opening surfaces of the housing 11 and the cover member 12 are held in the uprising direction thereof, in order to prevent the elastic securing member 21 disposed on the cover member 12 side from being caught between the cover member 12 and housing 11, the elastic securing member 21 may be provisionally positioned at a rather opened position. In this case, similarly to the case described above in connection with FIG. 4, the mounting operation of the cover member 12 onto the housing 11 can be executed smoothly.

By the way, in the above-mentioned embodiment, the securing structure 15 is disposed on the cover member 12 and the securing projection 14 is formed in the housing 11. However, this is not limitative but, alternatively, the above-structured securing structure 15 can also be disposed on the housing 11 and the securing projection 14 can also be formed in the cover member 12.

As has been described heretofore, according to the cover member securing structure of the invention, since an elastic securing member shiftably disposed on the outer surface of a cover member or a housing can be provisionally positioned at an arbitrary position, for example, when mounting the cover member onto the housing, the elastic securing member can be provisionally positioned in such a manner that the elastic securing member cannot be caught between the cover member and housing, which makes it possible to enhance the efficiency of the mounting operation of the cover member onto the housing. Also, even when a large number of cover members or housings each equipped with such elastic securing member are delivered or packed in a state where they are piled up vertically, the elastic securing members can be provisionally positioned at such positions that will not interfere with the delivering or packing operation. That is, according to the cover member securing structure of the invention, there can also be provided an operation effect that the delivering or packing operation can be carried out smoothly.

What is claimed is:

1. A cover member securing structure comprising:

a housing;

a cover member to be mounted on the housing;

an elastic securing member having a substantially C-shaped side surface formed on the basis on a band-shaped plate spring, one end of the elastic securing member being shiftably supported on one of the housing and the cover member, the other end of the elastic securing member being removably secured to the other of the housing and the cover member;

a hold piece in frictional contact with at least one of two side edges of the elastic securing member and arranged to position the shifting inclination position of the elastic securing member provisionally at an arbitrary position, the hold piece disposed on the same one of the housing and the cover member that the elastic securing member is shiftably supported on.

2. The cover member securing structure as claimed in claim 1, wherein the hold piece comprises a pair of hold pieces, and the two side edges of the elastic securing member are elastically held between the pair of hold pieces.

3. The cover member securing structure as claimed in claim 1, wherein the hold piece comprises a stopper for restricting the movement of the elastic securing member.

4. A cover member securing structure comprising:

a housing;

a cover member to be mounted on the housing;

an elastic securing member having a substantially C-shaped side surface formed on the basis on a band-shaped plate spring, one end of the elastic securing member being shiftably supported on one of the housing and the cover member, the other end of the elastic securing member being removably secured to the other of the housing and the cover member;

a hold piece for elastically holding two side edges of the elastic securing member arranged to position the shifting inclination position of the elastic securing member provisionally at an arbitrary position, the hold piece disposed in the one of the housing and the cover member; wherein the hold piece comprises a pair of hold pieces, and the two side edges of the elastic securing member are elastically held between the pair of hold pieces.

5. A cover member securing structure as claimed in claim 4, wherein said hold piece is in frictional contact with at least one of two side edges of the elastic securing member and is disposed on the same one of the housing and the cover member that the elastic securing member is shiftably supported on.

* * * * *